US009731529B2

(12) United States Patent
Toudmeri

(10) Patent No.: US 9,731,529 B2
(45) Date of Patent: Aug. 15, 2017

(54) MOUNTING APPARATUS

(71) Applicant: Dover Europe Sarl, Vernier (CH)

(72) Inventor: Mohammed Jamal Toudmeri, Birmingham (GB)

(73) Assignee: Dover Europe Sarl, Vernier (CH)

( * ) Notice: Subject to any disclaimer, the term of this patent is extended or adjusted under 35 U.S.C. 154(b) by 2 days.

(21) Appl. No.: 14/815,682

(22) Filed: Jul. 31, 2015

(65) Prior Publication Data

US 2016/0031241 A1 Feb. 4, 2016

(30) Foreign Application Priority Data

Jul. 31, 2014 (GB) ..... 1413620.4

(51) Int. Cl.

| | |
|---|---|
| ***B41J 29/06*** | (2006.01) |
| ***B41J 2/32*** | (2006.01) |
| ***B41J 3/407*** | (2006.01) |
| ***B41J 25/00*** | (2006.01) |
| ***B41J 25/304*** | (2006.01) |
| ***B41J 31/00*** | (2006.01) |
| ***B41J 29/02*** | (2006.01) |
| *B41J 15/00* | (2006.01) |
| *B41J 2/14* | (2006.01) |
| *B41J 15/08* | (2006.01) |

(52) U.S. Cl.

CPC ..... *B41J 29/06* (2013.01); *B41J 2/32* (2013.01); *B41J 3/4073* (2013.01); *B41J 25/001* (2013.01); *B41J 25/304* (2013.01); *B41J 29/02* (2013.01); *B41J 31/00* (2013.01); *B41J 2/14* (2013.01); *B41J 2/14024* (2013.01); *B41J 15/00* (2013.01); *B41J 15/08* (2013.01); *B41J 2202/20* (2013.01)

(58) Field of Classification Search

CPC ..... B41J 2/14024; B41J 2202/20; B41J 2/14; B41J 15/00; B41J 15/08; B41J 29/06; B41J 3/4073; B41J 25/001; B41J 2/32; B41J 25/304; B41J 31/00

See application file for complete search history.

(56) References Cited

U.S. PATENT DOCUMENTS 5,064,300 A 11/1991 Kashiwaba
5,880,757 A 3/1999 Ta
(Continued)

FOREIGN PATENT DOCUMENTS

DE 102006038750 A1 2/2008
JP H06143737 A 5/1994

OTHER PUBLICATIONS

European Patent Application No. 15179187.8, Extended European Search Report dated Dec. 3, 2015, 9 pages.

*Primary Examiner* — Lisa M Solomon
(74) *Attorney, Agent, or Firm* — Fish & Richardson P.C.

(57) ABSTRACT

A mounting apparatus for mounting a printing apparatus to a structure includes an attachment part, which is attachable to the structure, and a support member upon which a printing apparatus is supportable. The support member enables the printing apparatus to be located in a desired position along a first axis, which extends in a first direction relative to the structure, and wherein at least a part of a footprint of the support member defined in a first plane, which is substantially transverse to the first axis, overlaps at least a part of a footprint of the printing apparatus defined in a second plane, which is substantially transverse to the first axis.

30 Claims, 4 Drawing Sheets

(56) References Cited

U.S. PATENT DOCUMENTS

| | | | | |
|---|---|---|---|---|
| 2003/0108868 | A1 | 6/2003 | Richards | |
| 2006/0170729 | A1 | 8/2006 | Sloan | |
| 2007/0231040 | A1 | 10/2007 | Tamaki | |
| 2010/0033534 | A1 | 2/2010 | McCoy | |
| 2012/0013661 | A1 | 1/2012 | Smelser | |
| 2013/0127949 | A1 | 5/2013 | Ishida | |
| 2016/0039212 | A1* | 2/2016 | Elferink | B41J 25/001 347/20 |

* cited by examiner

MOUNTING APPARATUS

BACKGROUND

This invention relates to a mounting apparatus for mounting a printer apparatus to a structure, in particular, but not exclusively to a mounting apparatus for mounting a printing apparatus to a structure which forms part of a packaging apparatus.

In the art of packaging it is desirable to have a structure (for example a packaging apparatus) which combines all the components required to complete an entire packaging process. For example, the structure may include a conveyor for transporting products, a packaging substrate carrier and a printing apparatus for printing on a substrate (e.g. packaging for food, etc), and a wrapping apparatus to wrap the products in the packaging substrate, either before or after printing. It is known to provide a mounting apparatus to support the printing apparatus on the structure. Typically, the substrate carrier and printing apparatus are mounted to a mounting plate of the structure, so that, in use, during a packaging operation the substrate can be unwound from the substrate carrier, marked with the printing apparatus, and then transferred onto a product travelling along the conveyor, for example.

The packaging process typically includes marking the substrate (i.e. the packaging or wrapping material) with a desired text or image, for example an identifying bar code and/or best before date, and transferring the substrate onto a product.

One type of printing apparatus used in such processes typically includes a printing ribbon or tape, which bears ink, and a print head. In use, the substrate is usually passed over a platen plate or platen roller, which is positioned adjacent the printing apparatus, in proximity to the print head. During a printing operation, the print head sandwiches the printing ribbon and substrate between the print head and the platen plate or platen roller, and removes ink from selected areas of the printing ribbon, to transfer the ink onto the substrate to form an image, as discussed above.

An example of a known mounting apparatus 1 for a printing apparatus 2 is shown in FIG. 1. A structure 100 shown in FIG. 2 is an example of a packaging machine, which includes components for each stage of a packaging process, as described above. The structure 100 includes a substrate carrier 102 and printing apparatus 2 for printing packaging, a conveyor 103 for transporting products and a wrapping apparatus 104 for wrapping the products in the substrate. The packaging machine shown at 100 in FIG. 2 is an example of a flow-wrapping machine. Other forms of packaging machine are well known, which include the same or similar principles.

The mounting apparatus 1 includes a first end plate 3, a second end plate 4, a plurality of elongate support bars 5 and substrate guide rollers 13. The first end plate 3 has a first limb 3*a* and a second limb 3*b*, which are substantially orthogonal to one another, such that the limbs 3*a*, 3*b* form an L-shape. The second end plate 4 is substantially the same shape as the first end plate 3, having a first limb 4*a* and second limb 4*b*. The first end plate 3 is attachable to a mounting plate 101 of the structure 100. The second end plate 4 is spaced apart from the first end plate 3, and the elongate support bars 5 extend between the first and second end plates 3, 4. The elongate support bars 5 are arranged generally parallel to one another, either connecting respective first limbs 3*a*, 4*a* of the first and second end plates 3, 4 or connecting respective second limbs 3*b*, 4*b* of the first and second end plates 3, 4 resulting in a robust structure to support the printer. The printing apparatus 2 includes a clamping bracket or support 6, which is attachable to two of the elongate support bars 5, between the first and second end plates 3, 4. The substrate guide rollers 13 are elongate and extend in a direction which is substantially parallel to the elongate support bars 5, between the first parts 3*a*, 4*a* of the end plates 3, 4. Each of the substrate guide rollers 13 is positioned to guide the packaging substrate past a print head 11 of the printing apparatus 2 in the manner required by a printing process which may require the packaging substrate to at least partially wrap around the platen roller 15. In the example shown, a pair of substrate guide rollers 13 are shown. It will be appreciated that providing more or fewer substrate guide rollers 13 is also known. Other forms of bracket are known.

Generally, the mounting apparatus 1 and the printing apparatus 2 are provided to a packaging machine user (a user could be for example an installer, mechanic or operator) as separate components, to be assembled on site. The user ensures that the mounting apparatus 1 and the printing apparatus 2 are mounted correctly to the structure 100. Typically, the printing apparatus 2 is positioned at a specific position along the elongate support bars 5 (i.e. a particular position between the first and second end plates 3, 4), and the print head 11 is positioned relative to the platen plate or platen roller 15; typically there is about 1 mm between the platen and the print head. The print head must also be positioned within 0.5 mm horizontally of the apex of the platen roller (also known as the "top dead centre) position. It is difficult for an untrained user to configure the mounting apparatus 1 and the printing apparatus 2 within the tolerances needed for optimum printing quality.

Typically, the printing apparatus 2 will include a supply spool 7*a*, onto which the printing ribbon 9 is initially wound; and a take-up spool 7*b*. During a printing operation, the printing ribbon 9 is unwound from the supply spool 7*a*, threaded around multiple guides 8 which define a path of the printing ribbon 9, which includes passing under the print head 11, and finally wound onto the take-up spool 7*b*. Access to the printing apparatus 2 is required to allow the user to thread the printing ribbon 9 between the supply and take-up spools 7*a*, 7*b* (i.e. around the guides 8), and for general maintenance. A disadvantage of known mounting apparatus 1 is that the printing apparatus 2 is difficult to access because the elongate support bars 5 and second end plate 4 cause obstruction.

A further disadvantage of a conventional mounting apparatus 1 is that generally the mounting apparatus 1 dimensions (e.g. length and position of the elongate support bars 5 and/or the size of each of the end plates 3, 4) are dictated by the size of the printing apparatus 2 required for use with a particular structure 100 (i.e. there is no standard size of printing apparatus 2 or mounting apparatus 1). Additionally, the width of the substrate to be printed and/or its position relative to the structure 100 may vary according to the product being packaged and the packaging substrate being used. Different products require different sizes, i.e. widths, of packaging substrate and the position of the required printing may also change. As a consequence the position of the printing apparatus 2 on the elongate support bars 5 is variable, and may require adjustment. Since there is no typical size of mounting apparatus 1, a different sized mounting apparatus 1 must be manufactured for each differently sized printing apparatus 2. This increases the cost and time in designing and producing each mounting apparatus model (i.e. each mounting apparatus 1 must be bespoke to the printing apparatus 2 it supports).

In known arrangements, when the printing apparatus 2 is mounted in position on the mounting apparatus 1, cables and wires associated with powering and controlling the printing apparatus 2 are exposed between the position in which the printing apparatus 2 is mounted on the mounting apparatus 1 and the mounting plate 101 of the structure 100. This is a significant disadvantage because the exposed cables and wires must be located in a safe position to avoid user injury and operation failures that might occur if a wire is disconnected or damaged either during installation, maintenance, or during use of the structure 100.

Within the structure 100, space is at a premium. The mounting apparatus 1 takes up a significant amount of space (i.e. more area than the cross-sectional area of the printing apparatus 2). It is advantageous for a mounting apparatus 1 to take up as little space as possible within the structure 100. The printing apparatus 2 typically requires power supplies and other support equipment to be mounted in or on the structure 100. It is advantageous to position such items close to the printing apparatus 2.

SUMMARY

The present invention aims to ameliorate one or more problems associated with the prior art.

According to the present invention, there is provided a mounting apparatus for mounting a printing apparatus to a structure, the mounting apparatus including an attachment part which is attachable to the structure and a support member upon which a printing apparatus is supportable, the support member enabling the printing apparatus to be located in a desired position along a first axis which extends in a first direction relative to the structure, and wherein at least a part of a footprint of the support member, defined in a first plane which is substantially transverse to the first axis, overlaps at least a part of a footprint of the printing apparatus, defined in a second plane which is substantially transverse to the first axis.

The first plane and the second plane may be coincident with one another.

The support member and the printing apparatus may be substantially coaxial.

The entire footprint of at least a part of the support member may overlap the footprint of the printing apparatus.

The entire footprint of the support member may overlap the footprint of the printing apparatus.

At least one of the first plane and the second plane may be substantially orthogonal to the first axis.

The support member may be extendible/retractable along the first axis to adjust the position of the printing apparatus relative to the structure.

The support member may be telescopic.

The support member may include at least two parts which fit one inside the other.

At least a part of the support member may be configured to be received in an opening in a printing apparatus.

The support member may be configured to extend through the opening in the printing apparatus.

The support member may be configured to enable a printing apparatus to slide along at least a part of the support member.

The mounting apparatus may include a substrate guide member for guiding a substrate to be printed relative to a printing apparatus.

The mounting apparatus may include a platen to support a substrate during a print process.

The support member may provide a conduit to house one or more wires.

The support member may provide a housing for a power supply or other equipment.

The mounting apparatus may include a locking device for locking the printing apparatus in the desired position relative to the support member.

The printing apparatus may be a thermal transfer overprinter.

According to a second aspect of the invention there is provided a printing apparatus for use with a mounting apparatus according to any one of the preceding claims, wherein the printing apparatus includes an opening.

The opening may be positioned substantially centrally in the printing apparatus.

The opening may extend through the printing apparatus.

According to a third aspect of the invention, there is provided a combination of a mounting apparatus and a printing apparatus, the mounting apparatus including any of the features of the first aspect of the invention and the printing apparatus including any of the features of the second aspect of the invention.

The mounting apparatus may be integral with the printing apparatus.

According to a fourth aspect of the invention, there is provided a structure including a mounting apparatus according to the first aspect of the invention.

The structure may include a combination of a mounting apparatus and a printing apparatus.

The details of one or more embodiments of the subject matter described in this specification are set forth in the accompanying drawings and the description below. Other features, aspects, and advantages of the invention will become apparent from the description, the drawings, and the claims.

BRIEF DESCRIPTION OF THE DRAWINGS

Like reference numbers and designations in the various drawings indicate like elements.

DETAILED DESCRIPTION

Figure 2:
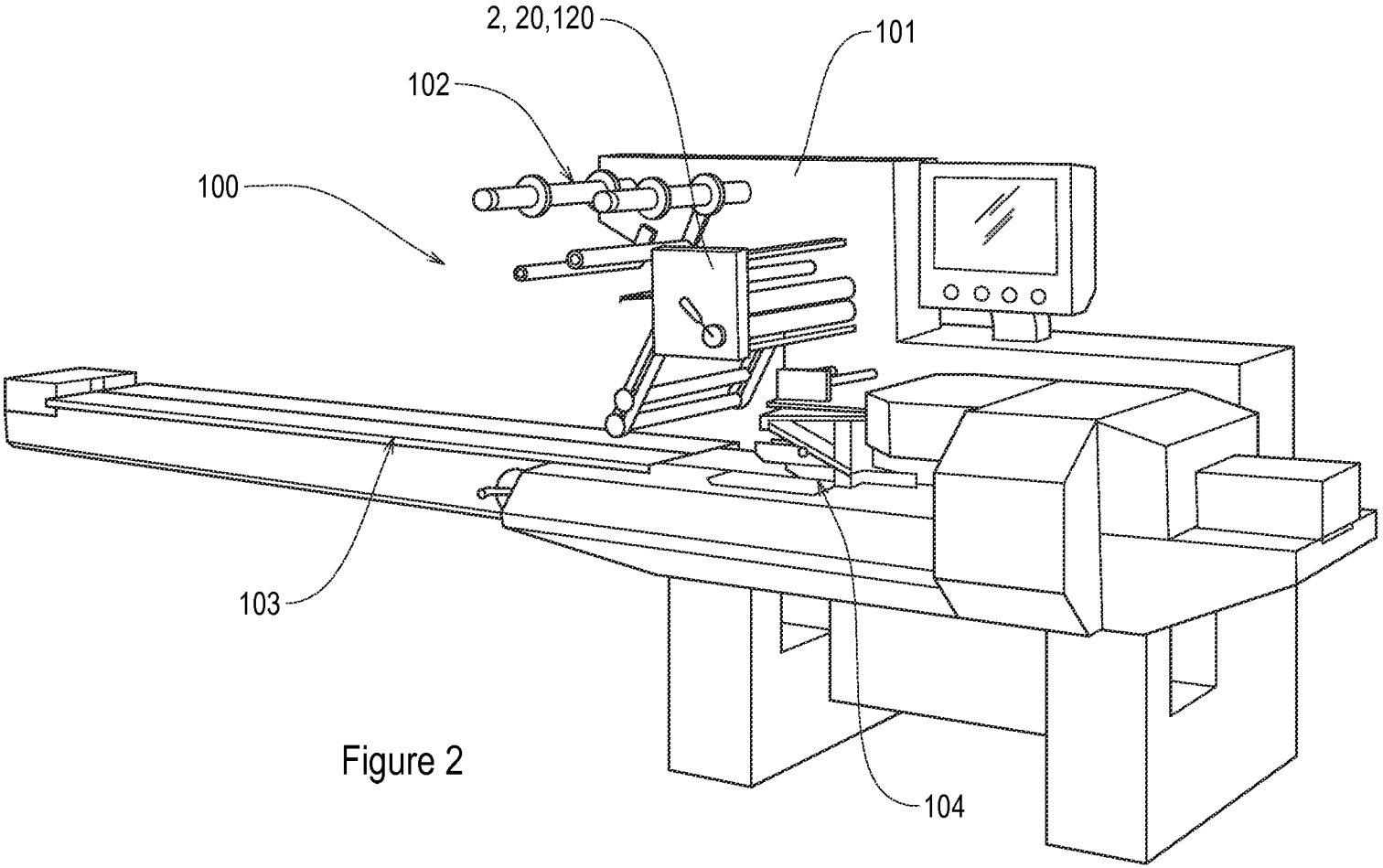
FIG. 2 shows an example of a packaging machine.
Figure 3:
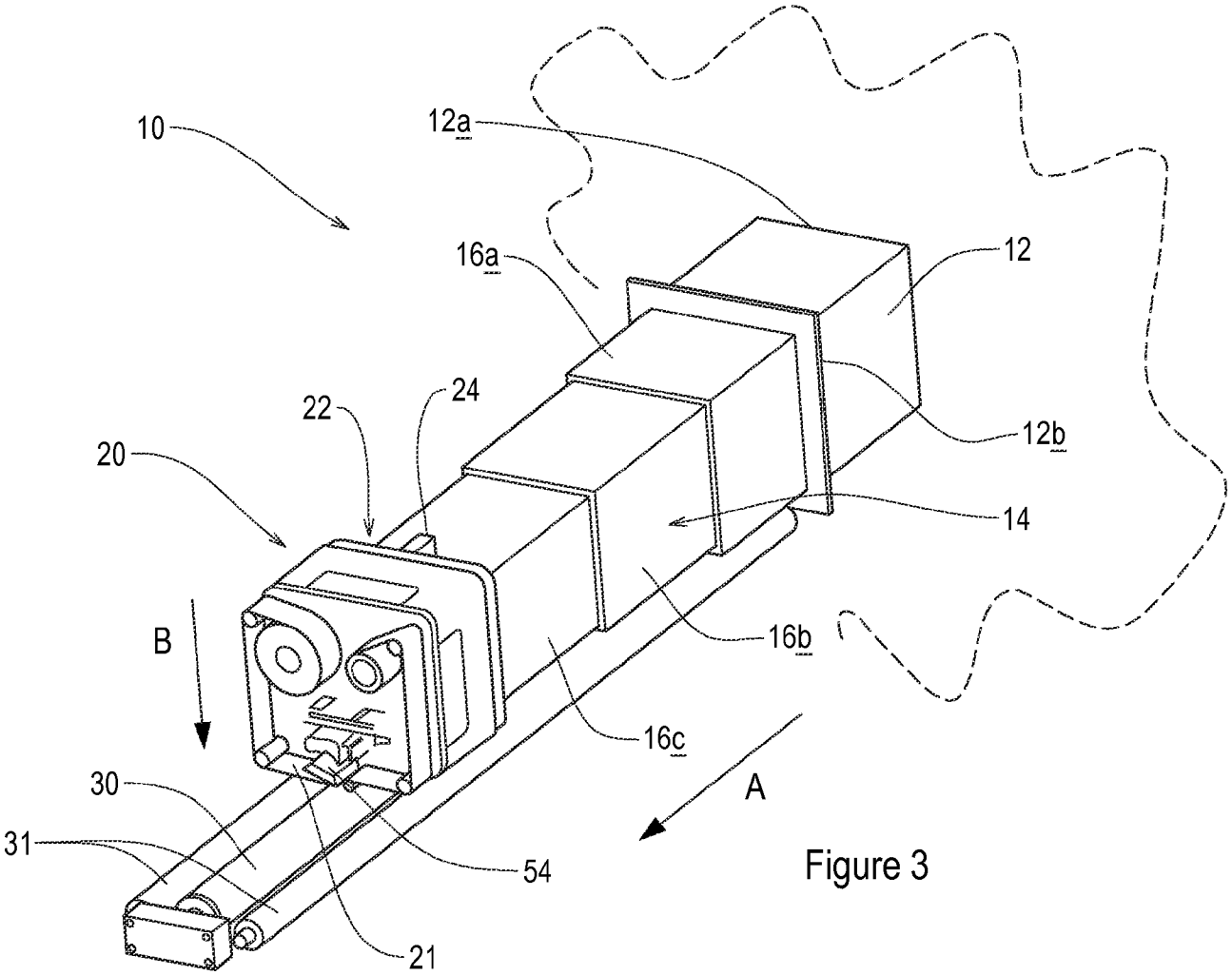
FIG. 3 shows a mounting apparatus in accordance with at least one embodiment of the invention.

Referring to FIG. 3, there is shown a mounting apparatus 10 which is configured to mount the printing apparatus 20 to the mounting plate 101 of the structure 100 as shown in FIG. 2. The mounting apparatus 10 includes an attachment part 12 and a support member 14. The attachment part 12 is attachable to the mounting plate 101. A first end 12*a* of the attachment part 12 is attachable to the mounting plate 101 of the structure 100, and a second end 12*b* of the attachment part 12 is attached to the support member 14. It will be appreciated that the attachment part 12 may be integral with the support member 14. In the example shown, the attachment part 12 has a substantially square tubular cross-section, although it will be appreciated that the attachment member may take any appropriate form, for example the attachment part may be a plate or block, and may be any shape, as appropriate.

The support member 14 of the mounting apparatus 10 extends from the attachment part 12 and supports the printing apparatus 20 in a desired position relative to the structure 100. The support member 14 includes an arrangement suitable for attaching the printing apparatus 20 to the support member 14. The fixing arrangement for attaching the support member 14 to the printing apparatus 20 is not shown, however it is well known to provide a plate or box section which may be fixed with screws or bolts or other types of known fixings. In the example shown, the fixing arrangement is attachable to a rear surface 22 of the printing apparatus 20, within a 'footprint' of the printing apparatus 20, the footprint of the printing apparatus 20 being the maximum cross sectional area of the printing apparatus in a first plane which is substantially transverse, in the present case orthogonal to, first axis A which extends substantially orthogonally from the substantially planar mounting plate 101 of the structure 100. Hence, the footprint of the printing apparatus 20 is the maximum cross sectional area of the printing apparatus 20 in a first plane which is substantially parallel to the mounting plate 101. It should be appreciated that the first axis A could extend in any direction, and need not be orthogonal to the mounting plate 101.

In the embodiment shown in FIG. 3, the support member 14 is retractable and extendible relative to the attachment part 12 in a direction parallel with the first axis A. The support member 14 is a telescopic arrangement, and includes first, second and third telescopic elements 16*a*, 16*c*. It will be appreciated that the support member 14 may include any number of telescopic parts which fit one inside another. In the present example, the first telescopic element 16*a* is adjacent the second end 12*b* of the attachment part 12 and attached thereto. The second and third telescopic elements 16*b*, 16*c* are adjacent the first and second telescopic elements 16*a*, 16*b*, respectively. Each telescopic element 16*a*, 16*b*, 16*c* has a substantially square tubular cross-section, with the first telescopic element 16*a* having the largest cross-section, and subsequent telescopic elements 16*b*, 16*c* having a slightly smaller cross-section. The third telescopic element 16*c* includes or may be attached to the fixing arrangement which is attachable to the rear of the printing apparatus 20 (as described above). It will be appreciated that the first telescopic element 16*a* may alternatively have the smallest cross-section, with each successive element 16*a-c* having a slightly larger cross-section than the preceding element 16*a-c*.

When the support member 14 is in a retracted (or minimum extended) position, the second and third telescopic elements 16*b*, 16*c* are substantially housed within the first telescopic element 16*a*, the distance between the attachment part 12 and the fixing arrangement which attaches the printing apparatus 20 to the support member 14 is a minimum (this distance can depend upon the type of packaging machine, and may vary between approximately 20 mm and 200 mm). When the support member 14 is in a maximum extended position, the distance between the attachment part 12 and the arrangement to attach to the printing apparatus 20 is a maximum (which can also depends upon the type of packaging machine, and may vary between 600 mm and 2000 mm, but in many implementations, the maximum distance is approximately 1200 mm).

The second telescopic element 16*b* extends from the first telescopic element 16*a*, and the third telescopic element 16*c* extends from the second telescopic element 16*b* (i.e. there is very little overlap between adjacent telescopic elements 16*a*, 16*b*, 16*c* in a direction parallel to the first axis A). Only the fully retracted and fully extended positions have been described but it will be appreciated that the telescopic elements 16*a*, 16*b*, 16*c* are adjustable such that any distance between the attachment part 12 and the fixing arrangement to attach the printing apparatus 20 to the support member 14 can be selected (i.e. configurations of the support member 14 where the second telescopic element 16*b* is not housed within the first telescopic element 16*a*, but the third telescopic element 16*c* is housed within the second telescopic element 16*b*, etc.). It should also be appreciated that the support member 14 may include any number of telescopic elements 16, and each of the telescopic elements 16 may have a different length in a direction parallel with the first axis A.

In the embodiment shown in FIG. 3, the mounting apparatus 10 also includes a platen roller 30. The platen roller 30 is located at a position generally adjacent the printing apparatus 20. The platen roller 30 extends in a direction which is substantially parallel to the first axis A. In the example shown, the platen roller 30 is a substantially cylindrical roller; however a flat platen could also be used.

During a printing operation, a print head 54 of the printing apparatus 20 is moveable in a direction B, towards the platen roller 30. A substrate is guided over the platen roller 30 such that it can be sandwiched between the print head 54 and the platen roller 30. During a different type of printing operation, for example, in intermittent printing, the print head 54 may need to move across the platen roller 30. Additional guide members 31 are optionally provided to guide the substrate past a print position of the print head 54 and provide any necessary wrapping of the substrate around the platen roller 30. The additional guide members 31 may take the form of rollers which extend in a direction which is substantially parallel to the first axis A.

The mounting apparatus 10 together with the printing apparatus 20 can be supplied together, in combination, with the printing apparatus 20 attached to or part of the support member 14. It is a simple matter for a user to attach the attachment part 12 to the mounting plate 101 of the structure 100. The position of the printing apparatus 20 along the first axis A may be predetermined or may be user-selected. Even in the case where the position of the printing apparatus 20 is predetermined, the position may be adjusted by the user, to optimise printing conditions or other settings. The movement of the printing apparatus 20 along the first axis A may be controlled manually or controlled by a powered device such as a motor.

The printing apparatus 20 may be lockable in the desired position along the first axis A, using a locking device 24. The locking device 24 may be carried by one or both of the printing apparatus 20 and the mounting apparatus 10.

When the printing apparatus 20 is supported by the mounting apparatus 10, at least a part of the footprint of the support member 14, i.e. the maximum cross sectional area of the support member 14 in a second plane which is transverse (in the present example substantially orthogonal) to the first axis A, overlaps the footprint of the printing apparatus 20. In a preferred embodiment, the entire footprint of the support member 14 overlaps the footprint of the printing apparatus 20. In other words, in the preferred embodiment, the footprint of the support member 14 does not extend beyond the perimeter of the footprint of the printing apparatus 20. The first and second planes at which the respective cross-sectional areas of the support member 14 and the printing apparatus 20 are defined may be coincident.

When the mounting apparatus 10 is in use the support member 14 is cantilevered from the mounting plate 101.

One or more wires (not shown) may be required to provide power and/or to control the printing apparatus 20. The wires may extend between the structure 100 and the printing apparatus 20. The mounting apparatus 10 houses one or more of the wires. Each of the telescopic elements 16*a*, 16*b*, 16*c* provides an inner passage or conduit through the support member 14 and the wires are housed inside the inner passage, between the mounting plate 101 of the structure 100 and the printing apparatus 20. The mounting plate 101 may include one or more openings through which wires may pass in order to be connected to other parts of the structure 100. When the support member 14 is in the retracted position there is potential for significant slackening of the wires extending between the structure 100 and the printing apparatus 20. The wires are concealed safely within the inner passage of the support member 14, meaning that a user is less likely to suffer injury through contacting exposed wires. This configuration also provides significant advantages because the wires are not exposed during normal operation of the printing apparatus 20, reducing the risk of damage or operational failure.

Figure 4:
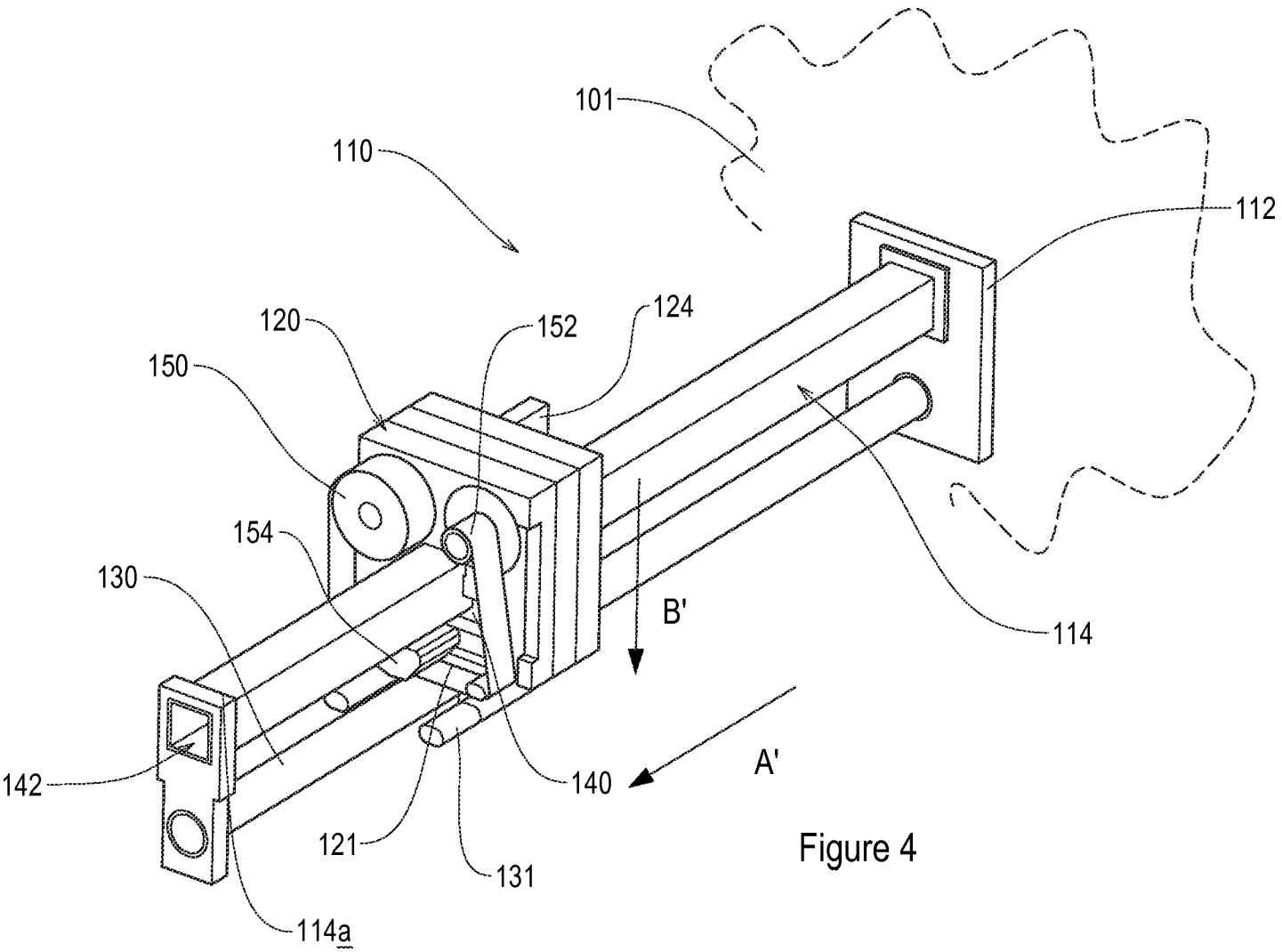
FIG. 4 shows a second mounting apparatus in accordance with at least one embodiment of the invention.

FIG. 4 illustrates a second embodiment of the present invention. Where analogous parts have been discussed previously in relation to the first embodiment, the reference numerals are identical with the addition of a preceding '1'. Unless stated otherwise, all features, or combinations of features, described in relation to the invention could be present in any embodiment.

FIG. 4 shows a mounting apparatus 110, configured to mount a printing apparatus 120 on a structure 100. The mounting apparatus 110 includes an attachment part 112 and a support member 114. The attachment part 112 is attachable to a mounting plate 101 of the structure 100 to secure the mounting apparatus 110 in a desired position relative to the structure 100 along a first axis A'. In this embodiment the attachment part 112 is plate-like and fixes to the structure using known fixings such as screws or bolts. The attachment part 112 may have any form and shape, as appropriate. The support member 114 is elongate and has a substantially rectangular cross-section 142 along its length, when mounted in position, the support member 114 extends along the first axis A' away from the structure 100, such that the support member 114 is cantilevered from the structure 100.

The printing apparatus 120 is a thermal transfer printer. The printing apparatus 120 includes a supply spool 150, onto which the printing ribbon 121 is initially wound; and a take-up spool 152. During a printing operation, the printing ribbon 121 is unwound from the supply spool 150, threaded around multiple guides, which define a path of the printing ribbon 121, which includes passing under the print head 54, 154, and finally wound onto the take-up spool 152.

The printing apparatus 120 is supported on the support member 114. At least a part of the support member 114 is receivable in an opening 140, which is provided in the printing apparatus 120. The opening 140 is positioned substantially centrally in the printing apparatus 120, and, in the example shown, extends through the printing apparatus 120. It will be appreciated that the opening 140 need not be centrally located within the printing apparatus 120. The printing components, such as supply and take-up spools 150, 152 and a printhead 154, are positioned around the opening 140. The opening 140 in the printing apparatus 120 corresponds to the size of the support member 140 in such a way that the printing apparatus 120 is adequately supported, and slidable along the support member 114.

In use, the printing apparatus 120 is supported on the support member 114, in a desired position/location along the axis A', relative to the mounting plate 101. Again, the printing apparatus 120 and the mounting apparatus 110 may be provided in combination, with the printing apparatus 110 attached to the support member 114. Since the printing apparatus 120 includes an opening in/through which at least a part of the support member 114 is receivable, the footprint of at least a part of the support member 114 overlaps the footprint of the printing apparatus 120.

The printing apparatus 120 is moveable relative to the support member 114, to a desired position relative to the structure 100, by sliding the printing apparatus 120 along the support member 114 in a direction which is substantially parallel to the first axis A'. The desired position of the printing apparatus may be any position between the mounting plate 101 and a maximum distance between the printing apparatus 120 and the attachment part 112 (i.e. the printing apparatus 120 is positioned substantially adjacent a distal end 114*a* of the support member 114).

During a printing operation, the printing apparatus 120 must be adequately supported (and secured) in position (for example, the printing apparatus 120 must remain in position even if the structure 100 vibrates during use). It should be appreciated that this may be achieved using friction between the support member 114 and the opening 140 in the printing apparatus 120. However, the mounting apparatus 110 may include a lock 124 to fix the printing apparatus 120 in position relative to the support member 114. The lock 124 may be provided on at least one of the support member 114 and the printing apparatus 120. It should be appreciated that the movement of the printing apparatus 120 along the first axis A' may be controlled manually or controlled by a powered device such as a motor.

The FIG. 4 also includes a platen roller 130 and additional guide members 131 both as described above in relation to the first embodiment. The platen roller 130 is located in a fixed position generally adjacent the printing apparatus 120. During a printing operation a print head 154 moves in a direction B', towards the platen roller 130.

Similarly to the first embodiment the support member 114 may include a hollow part which provides a passage to house wires or cables which extend between the printing apparatus 120 and the structure 100 together with power supplies and other support equipment required by the printing apparatus 120.

In the figures, the printing apparatus 20, 120 is a thermal transfer overprinting device. However, it should be appreciated that each mounting apparatus 10, 110 is compatible with many different types of printing apparatus.

It should be appreciated that the mounting apparatus 10, 110 in accordance with the invention is preferably supplied to the user with the printing apparatus 20, 120 already attached or mounted to the support member 14, 114, thus simplifying installation.

The mounting apparatus 10, 110 is also preferably supplied with the platen roller 30, 130 attached to the attachment part 12, 112. As the mounting apparatus 10, 110, printing apparatus 20, 120 and substrate guide member 31, 131 can all be supplied as one part, installation is greatly simplified. Calibration in order to achieve optimum printing quality is simplified, because the accurate positioning of the printing apparatus 20, 120 and/or the platen roller 30, 130 required for quality printing are set by the manufacturer, prior to shipping. The distance between the print head 54, 154 and the substrate guide member 30, 130, which is typically approximately 1 mm, and the print head 54, 154 is positioned within 0.5 mm horizontally from the apex of the substrate of the platen roller 30, 130).

The mounting apparatus 10, 110 may be used in more systems than previously known mounting apparatus, because it is more compact (i.e. the mounting apparatus 10, 110 covers a cross-sectional area of the mounting plate 101 which is similar to the cross-sectional area of the printing apparatus 20, 120). The mounting apparatus 10, 110 may cover a smaller cross-sectional area of the mounting plate 101 than the printing apparatus 20, 120. The mounting apparatus 10, 110 may have a similar or smaller overall footprint than the printing apparatus 20, 120.

The mounting apparatus 10, 110 may be attached to different models of printing apparatus 20, 120. It should be appreciated that producing a single model of mounting apparatus 10, 110 which is compatible with many models of printing apparatus 20, 120 reduces the cost of development and manufacture.

Figure 1:
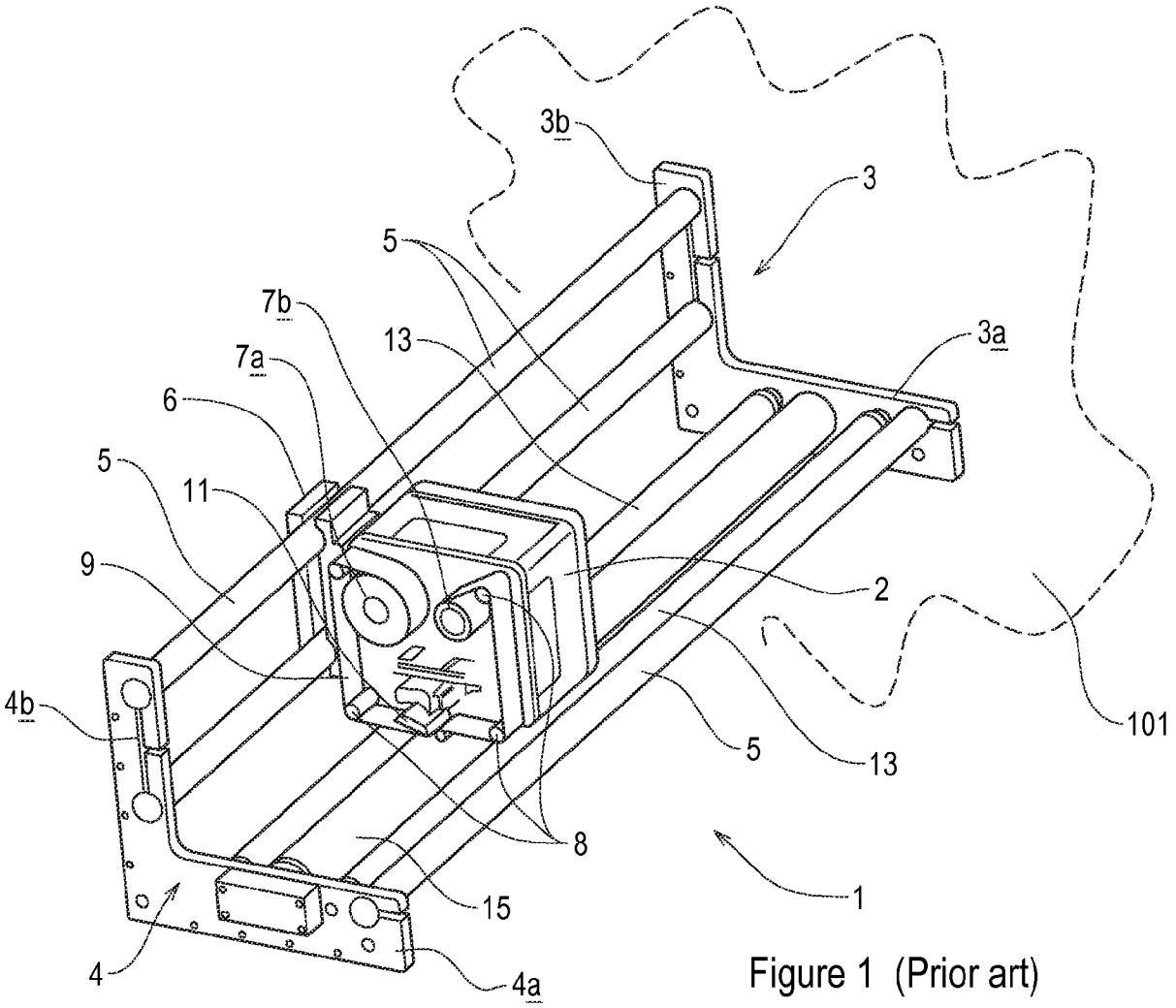
Figure 1 (Prior art)
FIG. 1 shows a known mounting apparatus for a printing apparatus.

The current invention, when compared to the prior art, also has the advantage of granting better access for maintenance, and for threading the printing ribbon 21, 121 onto the printing apparatus 20, 120. There are no elongate support bars (see FIG. 1, reference 5) at the side of the printing apparatus 2, or large end plates (see FIG. 1, reference 4), hindering access to the printing apparatus 20, 120. The printing apparatus 20, 120 is unobstructed by the support member 14, 114.

The two embodiments of the invention described above may be combined. For example a mounting apparatus may be provided which includes a support member which extends into/through an opening in a printing apparatus and the support member may include at least a portion which is telescopic.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A mounting apparatus for mounting a printing apparatus to a structure, the mounting apparatus including an attachment part which is attachable to the structure and a support member upon which a printing apparatus is supportable, the support member enabling the printing apparatus to be located in a desired position along a first axis which extends in a first direction relative to the structure, and wherein at least a part of a footprint of the support member, defined in a first plane which is substantially transverse to the first axis, overlaps at least a part of a footprint of the printing apparatus, defined in a second plane which is substantially transverse to the first axis, and wherein the support member is extendible/retractable along the first axis to adjust the position of the printing apparatus relative to the structure.

2. A mounting apparatus according to claim 1, wherein the first plane and the second plane are coincident with one another.

3. A mounting apparatus according to claim 1, wherein the support member and the printing apparatus are substantially coaxial.

4. A mounting apparatus according to claim 1, wherein the entire footprint of at least a part of the support member overlaps the footprint of the printing apparatus.

5. A mounting apparatus according to claim 1, wherein at least one of the first plane and the second plane is substantially orthogonal to the first axis.

6. A mounting apparatus, for mounting a printing apparatus to a structure, the mounting apparatus including an attachment part which is attachable to the structure and a support member upon which the printing apparatus is supportable, the support member enabling the printing apparatus to be located in a desired position along a first axis which extends in a first direction relative to the structure, and wherein at least a part of a footprint of the support member, defined in a first plane which is substantially transverse to the first axis, overlaps at least a part of a footprint of the printing apparatus, defined in a second plane which is substantially transverse to the first axis;

wherein the support member is extendible/retractable along the first axis to adjust the position of the printing apparatus relative to the structure; and wherein the mounting apparatus includes a substrate guide member for guiding a substrate to be printed relative to the printing apparatus, and/or the mounting apparatus includes a platen to support a substrate during a print process, and/or the printing apparatus is a thermal transfer overprinter.

7. A mounting apparatus according to claim 1, wherein the first plane and the second plane are parallel with one another.

8. A mounting apparatus according to claim 1, wherein the entire footprint of the support member overlaps the footprint of the printing apparatus.

9. A mounting apparatus according to claim 6, wherein the support member provides a conduit to house one or more wires.

10. A mounting apparatus according to claim 6, wherein the support member includes at least two parts which fit one inside the other.

11. A mounting apparatus according to claim 6, wherein the support member is telescopic.

12. A mounting apparatus according to claim 6, wherein the support member provides a housing for a power supply or other equipment.

13. A mounting apparatus according to claim 6, including a locking device for locking the printing apparatus in the desired position relative to the support member.

14. A combination of a printing apparatus, which includes a supply spool and a take-up spool for holding printing ribbon, and a mounting apparatus for mounting the printing apparatus to a structure, the mounting apparatus including an attachment part which is attachable to the structure and a support member upon which the printing apparatus is supportable, the support member enabling the printing apparatus to be located in a desired position along a first axis which extends in a first direction relative to the structure, and wherein at least a part of a footprint of the support member, defined in a first plane which is substantially transverse to the first axis, overlaps at least a part of a footprint of the printing apparatus, defined in a second plane which is substantially transverse to the first axis, and wherein the support member is extendible/retractable along the first axis to adjust the position of the printing apparatus relative to the structure.

15. A combination of a mounting apparatus and a printing apparatus according to claim 14, wherein the mounting apparatus is integral with the printing apparatus.

16. A combination of a mounting apparatus and a printing apparatus according to claim 14, wherein the first plane and the second plane are parallel with one another.

17. A combination of a mounting apparatus and a printing apparatus according to claim 14, wherein the first plane and the second plane are coincident with one another.

18. A combination of a mounting apparatus and a printing apparatus according to claim 14, wherein the support member and the printing apparatus are substantially coaxial.

19. A combination of a mounting apparatus and a printing apparatus according to claim 14, wherein the entire footprint of at least a part of the support member overlaps the footprint of the printing apparatus.

20. A combination of a mounting apparatus and a printing apparatus according to claim 14, wherein the entire footprint of the support member overlaps the footprint of the printing apparatus.

21. A combination of a mounting apparatus and a printing apparatus according to claim 14, wherein at least one of the first plane and the second plane is substantially orthogonal to the first axis.

22. A combination of a mounting apparatus and a printing apparatus according to claim 14, wherein the support member is telescopic.

23. A combination of a mounting apparatus and a printing apparatus according to claim 14, wherein the support member includes at least two parts which fit one inside the other.

24. A combination of a mounting apparatus and a printing apparatus according to claim 14, wherein the mounting apparatus includes a substrate guide member for guiding a substrate to be printed relative to the printing apparatus, and/or the mounting apparatus includes a platen to support a substrate during a print process, and/or the printing apparatus is a thermal transfer overprinter.

25. A combination of a mounting apparatus and a printing apparatus according to claim 14, wherein the support member provides a conduit to house one or more wires.

26. A combination of a mounting apparatus and a printing apparatus according to claim 14, wherein the support member provides a housing for a power supply or other equipment.

27. A combination of a mounting apparatus and a printing apparatus according to claim 14, including a locking device for locking the printing apparatus in the desired position relative to the support member.

28. A mounting apparatus according to claim 1, wherein the mounting apparatus includes a substrate guide member for guiding a substrate to be printed relative to the printing apparatus, and/or the mounting apparatus includes a platen to support a substrate during a print process, and/or the printing apparatus is a thermal transfer overprinter.

29. A mounting apparatus according to claim 1, wherein the support member provides a housing for a power supply or other equipment.

30. A mounting apparatus according to claim 1, including a locking device for locking the printing apparatus in the desired position relative to the support member.

* * * * *